US011472195B2

(12) United States Patent
Solano Pallarol et al.

(10) Patent No.: US 11,472,195 B2
(45) Date of Patent: Oct. 18, 2022

(54) REDUNDANCY PRINT MODES

(71) Applicant: HEWLETT-PACKARD DEVELOPMENT COMPANY, L.P., Spring, TX (US)

(72) Inventors: Montserrat Solano Pallarol, Sant Cugat del Valles (ES); Peter Morovic, Sant Cugat del Valles (ES); Jan Morovic, London (GB)

(73) Assignee: Hewlett-Packard Development Company, L.P., Spring, TX (US)

( * ) Notice: Subject to any disclaimer, the term of this patent is extended or adjusted under 35 U.S.C. 154(b) by 146 days.

(21) Appl. No.: 16/977,550

(22) PCT Filed: Mar. 14, 2018

(86) PCT No.: PCT/US2018/022432
§ 371 (c)(1),
(2) Date: Sep. 2, 2020

(87) PCT Pub. No.: WO2019/177604
PCT Pub. Date: Sep. 19, 2019

(65) Prior Publication Data

US 2020/0398584 A1 Dec. 24, 2020

(51) Int. Cl.
*B41J 2/205* (2006.01)
*B41J 29/393* (2006.01)
(Continued)

(52) U.S. Cl.
CPC ..... *B41J 2/2052* (2013.01); *B41J 2/175* (2013.01); *B41J 2/21* (2013.01); *B41J 29/393* (2013.01)

(58) Field of Classification Search
CPC ... B41J 2/2052; B41J 2/175; B41J 2/21; B41J 29/393; B41J 29/38
(Continued)

(56) References Cited

U.S. PATENT DOCUMENTS 4,963,882 A 10/1990 Hickman
5,645,899 A 7/1997 Unterberger
(Continued)

FOREIGN PATENT DOCUMENTS

CN 1860030 11/2006
CN 106255598 12/2016
(Continued)

OTHER PUBLICATIONS

"Technology Backgrounder: HP T300 Color Inkjet Web Press", Aug. 15, 2009, <http://www.hp.com/hpinfo/newsroom/press_kits/2009/GSBatPrint09/HP_T300_Tech_Backgrounder.pdf>.

*Primary Examiner* — Kristal Feggins
*Assistant Examiner* — Alexander D Shenderov
(74) *Attorney, Agent, or Firm* — HP Inc. Patent Department

(57) ABSTRACT

In an example, a print system includes a redundancy engine, a separation engine, and a print engine. In that example, the redundancy engine may identify a group of nozzles based on a redundancy characteristic of a plurality of print head nozzles of a print head to be received at the print head station and the separation engine may select a color separation operation corresponding to a drop domain associated with the group of nozzles identified by the redundancy engine to operate the print head with redundancy. In that example, the print engine may generate instructions using the selected color separation operation to cause the print head to eject print fluid from a combination of nozzles corresponding to the group of nozzles based on the drop domain to operate the print head with a redundancy print mode.

20 Claims, 6 Drawing Sheets

(51) Int. Cl.
*B41J 29/38* (2006.01)
*B41J 2/175* (2006.01)
*B41J 2/21* (2006.01)

(58) Field of Classification Search
USPC ..... 347/15
See application file for complete search history.

(56) References Cited

U.S. PATENT DOCUMENTS

| | | | | |
|---|---|---|---|---|
| 6,595,611 | B1 | 7/2003 | Ruffing | |
| 6,942,308 | B2 | 9/2005 | Molinet | |
| 7,261,388 | B2 | 8/2007 | Vega | |
| 7,789,504 | B2 | 9/2010 | Tombs | |
| 2003/0214551 | A1* | 11/2003 | Yabe | B41J 2/2125 347/40 |
| 2011/0261119 | A1 | 10/2011 | Drury | |
| 2012/0081442 | A1 | 4/2012 | Ikeda | |
| 2020/0108632 | A1* | 4/2020 | Billow | B41J 2/465 |

FOREIGN PATENT DOCUMENTS

| | | |
|---|---|---|
| EP | 0655337 | 5/1995 |
| EP | 0881077 | 12/1998 |
| JP | 2004058649 | 2/2004 |
| WO | WO-2015163903 A1 | 10/2015 |

* cited by examiner

REDUNDANCY PRINT MODES

BACKGROUND

Images are processed for use with computing machines, such as a print apparatus. A print apparatus, for example, may use control data based on processed image data to reproduce a physical representation of an image by operating a print fluid ejection system according to the control data.

DETAILED DESCRIPTION

Figure 1:
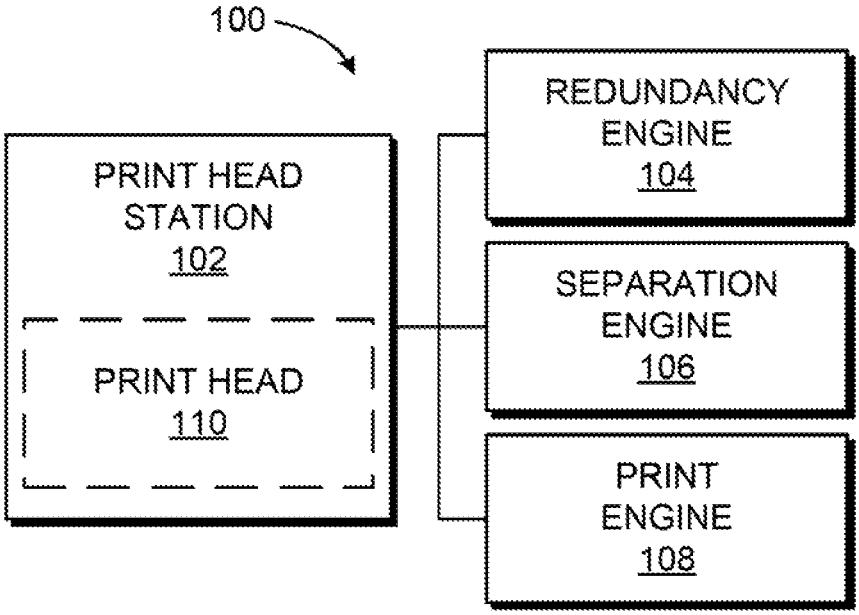
FIGS. 1 and 2 are block diagrams depicting example print systems.

In the following description and figures, some example implementations of print apparatus, print systems, and/or methods of operating a print head are described. In examples described herein, a "print apparatus" may be a device to print content on a physical medium (e.g., paper, textiles, a layer of powder-based build material, etc.) with a print material (e.g., ink or toner). For example, the print apparatus may be a wide-format print apparatus that prints latex-based print fluid on a print medium, such as a print medium that is size A2 or larger. In some examples, the physical medium printed on may be a web roll or a pre-cut sheet. In the case of printing on a layer of powder-based build material, the print apparatus may utilize the deposition of print materials in a layer-wise additive manufacturing process. A print apparatus may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

Certain examples described herein relate to color and pipeline calibration of a print system. For example, color calibration may be used to adjust the color response of the print system to more accurately correspond to a desired color to be printed. Color calibration may be used to calibrate a color mapping process by which a first representation of a given color is mapped to a second representation of the same color. In an example printing pipeline, individual inks may be calibrated separately so that printed colors are similar to or match desired colors.

A color model may define a color space, i.e., a multi-dimensional space with dimensions of the space representing variables within the color model and a point in the multi-dimensional space representing a color value. For example, in a red, green, blue (RGB) color space, an additive color model defines three variables representing different quantities of red, green and blue light. Another color space includes a cyan, magenta, yellow and black (CMYK) color space, in which four variables are used in a subtractive color model to represent different quantities of colorant or ink, e.g., for a print system and an image with a range of different colors can be printed by overprinting images for each of the colorants or inks.

Other spaces include area coverage spaces, such as the Neugebauer Primary area coverage (NPac) space. NPac space may be used as a print control space that controls a color output of an imaging device. An NPac vector in the NPac space represents a statistical distribution of one or more Neugebauer Primary (NP) vectors over an area of a halftone. An NP may include one of $N^k$ combinations of k inks within the print system, such as in the context of multi-level printers where print heads are able to deposit N drop levels (e.g., via multiple print passes or print-bars). For example, in a simple binary (bi-level, i.e., two drop state: "drop" or "no drop") printer, an NP is one of $2^k$ combinations of k inks within the print system. In an example of a print apparatus that uses CMY inks, there can be eight NPs: C, M, Y, C+M, C+Y, M+Y, C+M+Y, and W (white or blank indicating an absence of ink). An NP may comprise an overprint of available inks, such as a drop of magenta on a drop of cyan (for a bi-level printer) in a common addressable print area (e.g., a printable 'pixel').

Each NPac vector may define the probability distribution for one or more colorant or ink combinations for each pixel in a halftone (e.g., a likelihood that a particular colorant or ink combination is to be placed at each pixel location in the halftone). In this manner, a given NPac vector defines a set of halftone parameters that can be used in the halftoning process to map a color to one or more NP vectors to be statistically distributed over the plurality of pixels for a halftone. Moreover, the statistical distribution of NPs to pixels in the halftone serves to control the colorimetry and other print characteristics of the halftone. Spatial distribution of the NPs according to the probability distribution specified in the NPac vector may be performed using any suitable halftoning methods, such as matrix-selector-based Parallel Random Area Weighted Area Coverage Selection (PARAWACS) techniques and techniques based on error diffusion. An example of a print system that uses area coverage representations for halftone generation is a Halftone Area Neugebauer Separation (HANS) pipeline. An example HANS pipeline may utilize various sets of resources and/or various methods to perform image processing on the pipeline in preparation to cause a print apparatus to produce an image.

Some print apparatus may perform prints with multiple passes (or swaths) of a movable print carriage to eject print fluid over the same area of the print medium to improve image quality. Other print apparatus may include multiple print bars allowing for multiple sets of print heads in parallel to allow for improved image quality. Both examples attempt to place more than a single drop at each location of the print medium. In other print apparatus, a single, fixed print bar may be unable to achieve the image quality of other print apparatus capable of performing multiple passes or having multiple print bars.

Various examples described below relate to a redundancy print mode for print apparatus with a fixed print bar. Print heads may include a plurality of nozzles that may correspond to a particular print fluid (e.g., designated to receive and eject the particular print fluid), where some print heads include a plurality of nozzles for a particular print fluid among multiple trenches. Such nozzle arrangements may be addressed to act with redundancy by changing the pipeline processing to generate print head instructions to perform nozzle actuations over a drop domain corresponding to redundancy groups of the nozzles. By addressing groups of nozzles to act over the same location in a single pass, a print apparatus with a fixed print bar may print in a redundancy print mode to improve image quality.

Figure 2:
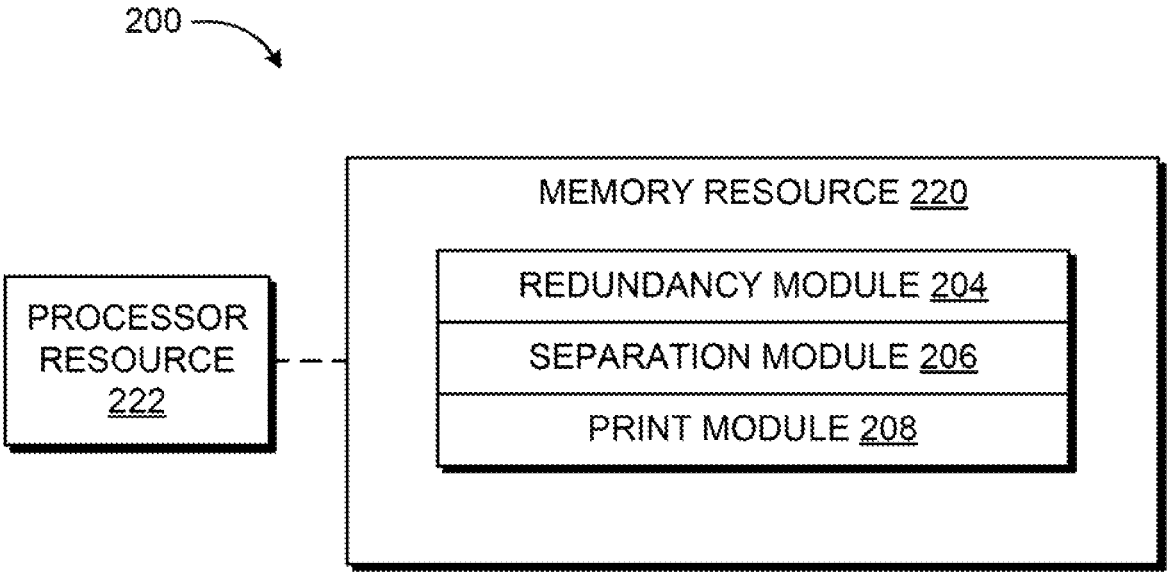

FIGS. 1 and 2 are block diagrams depicting example print systems 100 and 200. Referring to FIG. 1, the example print system 100 of FIG. 1 generally includes a print head station 102, a redundancy engine 104, a separation engine 106, and a print engine 108. In general, the print engine 108 generates instructions to operate a print head 110 coupleable to the print head station 102 in a redundancy print mode based on a color separation performed by the separation engine 106 when the redundancy engine 104 determines that a redundancy characteristic of the print head 110 allows for the print head 110 to act with redundancy. As used herein, "redundancy" represents the capability to eject print fluid on substantially the same location of the print medium, and a "redundancy print mode" represents a print mode of the print apparatus that causes a plurality of nozzles to operate in groups corresponding to a drop domain capable of redundancy.

The print head station 102 represents any structural mechanism to fluidly couple a print head 110 to a print apparatus and communicatively couple the print head 110 to the print system 100. For example, the print head station 102 may include a tubing interface to couple a print fluid supply channel to the print head 110 and an electrical interface to couple to circuitry on the print head 110 to induce the print head 110 to actuate the nozzles of the print head 110 (e.g., cause a thermal resistor of a thermal inkjet print head to fire to cause print fluid to eject from a nozzle corresponding to the thermal resistor). The print head 110 receivable by the print head station 102 may include a plurality of nozzles in a plurality of trenches corresponding to a particular print fluid supply channel (e.g., multiple trenches corresponding to a cyan colorant supply and multiple trenches corresponding to a magenta colorant supply, etc.).

The redundancy engine 104 represents any circuitry or combination of circuitry and executable instructions to identify a group of nozzles based on a redundancy characteristic of the plurality of print head nozzles of the print head 110 to be received at the print head station 102. For example, the redundancy engine 104 may be a combination of circuitry and executable instructions to select a lookup table with groups of nozzles in a drop domain corresponding to the plurality of nozzles of the print head 110. The redundancy engine 104 may identify the group of nozzles based on redundancy characteristic by selecting a set of processing resources corresponding to a drop domain capable of operation with the print head 110 based on a redundancy characteristic of the print head 110.

As used herein, a "redundancy characteristic" of a print head may correspond to a mechanical property of the print head that allows for redundancy mapping of nozzles of the print head. An example redundancy characteristic may be a number of trenches of the nozzle or a nozzle resolution specification above a threshold. For example, the print head 110 may include a plurality of trenches corresponding to a single colorant print fluid (e.g., trenches coupled to the same print fluid supply channel or otherwise associated with a common delivery path) and the redundancy engine 104 may identify a column of nozzles being the group of nozzles corresponding to a nozzle position of the nozzles in each of the trenches and determine a number of drops state options based on the number of trenches of the print head and the resolution of the print head 110. In that example, a redundancy characteristic corresponds to a number of trenches of a die output from a common delivery path designated to a particular print fluid. In another example, a number of trenches may correspond to delivery paths associated with related print fluids, such as a light cyan and a dark cyan, where the redundancy print mode pipeline resources may be adjusted to use a light and/or dark version of the print fluid for redundancy purposes.

The redundancy engine 104 may include circuitry or a combination of circuitry and executable instructions to define the drop domain by associating a drop state for each nozzle in a group (e.g., each nozzle in a column position of rows of trenches). The redundancy engine 104 may identify a plurality of nozzle redundancy options (e.g., a number of print modes that allow for redundancy) based on a number of nozzles of identifiable nozzle groupings based on the number of trenches of the print head 110. For example, if there are four trenches allocated to a similar print fluid, then there may be a combination of redundancy options, such as operating two groups of two drop states, operating a group of four nozzles in a column, or operating a group of three drops states and a group of one drop state, etc. In that example, the number of drop states may be weighted towards particular colorants based on the desired halftone effect, such as using three trenches for darker cyan and one trench for lighter cyan. The redundancy engine 104 may select the group of nozzles from the number of identifiable nozzle groupings based on the print job data. The print job data may include print job type (e.g., a graphics image or a technical image), the status of the print apparatus (e.g., such as the types of colorants available) or a print mode selected by a user that may indicate redundancy is to be used.

The redundancy engine 104 may identify a number of the multiple drop states that correspond to a number of drop cells in a group (a drop cell represents a nozzle of the print head) and a divisible of the print head resolution. The drop domain may be changed to address multiple drop cells to act as a single drop cell. In this manner, different color separation operations (e.g., color mapping) may be performed appropriate to whether a lower print resolution with redundancy is to be used or a higher print resolution without redundancy is to be used.

The separation engine 106 represents any circuitry or combination of circuitry and executable instructions to control a processing pipeline to use color resources corresponding to the redundancy print mode using the image data resolution that is less than the print head resolution. For example, the separation engine 106 may be a combination of circuitry and executable instructions to select a color separation operation corresponding to a drop domain associated with the group of nozzles identified by the redundancy engine 104 to operate the print head 110 with redundancy. For example, the separation engine 106 may be a combination of circuitry and executable instructions to initiate a color separation operation corresponding to a drop domain that selects nozzles of the column to actuate based on the drop state for the group of nozzles corresponding to the redundancy characteristic of the print head 110. For another example, the separation engine 106 may generate halftone data from the color separation operation to cause the print head to eject print fluid from a combination of nozzles corresponding to a group of nozzles based on the drop domain to operate the print head 110 with a redundancy print mode. In that example, the combination of nozzles may be a subset of all the nozzles of the group, for example, when the drop state is less than actuating all nozzles in the column position of the associated trenches and the color separation operation may choose to select the nozzles of the subset of each column to actuate randomly or based on a pattern. Multiple color separations operations may be available and may be selected by the separation engine 106 based on the determined drop domain and/or printing parameters of the print job.

The separation engine 106 may perform the color separation operation to generate halftone data at a divisible of the print head resolution based on a number of redundancies corresponding to the number of drop states available. For example, the divisible may be based on the number of trenches allocated to each print fluid supply channel (e.g., delivery path) and the halftone data may distribute a number of nozzle actuations less than the number of trenches to the drop cells of the group according to a redundancy addressing scheme to allow for each group to operate with redundancy. As used herein, a "redundancy addressing scheme" is a processing organization having a number of drop states corresponding to nozzles of a group. An example of a redundancy addressing scheme may allocate a column of nozzles into groups, were each group may include a nozzle from each of the number of trenches fluidly coupled to the same print fluid supply channel. For example, the redundancy addressing scheme may coordinate the use of a drop domain of drop cells where the drop cells are defined to operate multiple nozzles (e.g., a group of nozzles) rather than as single nozzles and a nozzle of the group actuates randomly or based on a pattern within the group consistent with the halftone data resulting of the color separation operation.

The print engine 108 represents any circuitry or combination of circuitry and executable instructions to generate instructions using the selected color separation operation to cause the print head to eject print fluid from a combination of nozzles corresponding to the group of nozzles based on the drop domain to operate the print head 110 with a redundancy print mode. In some examples, a subset of nozzles of the group of cells may be actuated, and in other examples, all nozzles of the group of cells may be actuated; the difference of examples may be based on the redundancy print mode to be used and the halftone data resulting from the color separation operation performed by the separation engine 106.

The print engine 108 may generate instructions to synchronize a print speed (e.g., paper advance) of a printer with a drop speed of the print head such that a group of single drop cells with a constant media coordinate operate as a single cell with multiple drop states (e.g., a number of drop states corresponding to redundancy based on the divisibility of the plurality of print head nozzles on a single print head die). For example, a delay among nozzles may be used to assist synchronization of ejection of drops from the nozzles consistent with the media advance to ensure the drops are placed in the same coordinate location or different coordinate locations based on the redundancy print mode to be used. The print engine 108 may identify printing parameters including a media speed and a drop speed to assist in synchronization of the drop speed.

In some examples, functionalities described herein in relation to any of FIGS. 1-2 may be provided in combination with functionalities described herein in relation to any of FIGS. 3-7.

FIG. 2 depicts the example system 200 may comprise a memory resource 220 operatively coupled to a processor resource 222. Referring to FIG. 2, the memory resource 220 may contain a set of instructions that are executable by the processor resource 222. The set of instructions are operable to cause the processor resource 222 to perform operations of the system 200 when the set of instructions are executed by the processor resource 222. The set of instructions stored on the memory resource 220 may be represented as a redundancy module 204, a separation module 206, and a print module 208. The redundancy module 204, the separation module 206, and the print module 208 represent program instructions that when executed cause function of the redundancy engine 104, the separation engine 106, and the print engine 108 of FIG. 1, respectively. The processor resource 222 may carry out a set of instructions to execute the modules 204, 206, 208, and/or any other appropriate operations among and/or associated with the modules of the system 200. For example, the processor resource 222 may carry out a set of instructions to identify a group of nozzles based on a redundancy characteristic of the plurality of print head nozzles of the print head, select a color separation operation corresponding to a drop domain associated with the group of nozzles, and use the color separation operation to cause a print head to eject print fluid from a combination of nozzles corresponding to the group of nozzle based on the drop domain to operate the print head with a redundancy print mode. For another example, the processor resource 222 may carry out a set of instructions to generate instructions to control the processing pipeline to perform a color separation operation to generate halftone data with a resolution at a divisible of the print head resolution based on the number of trenches fluidly coupled to the print fluid supply channel in response to receiving a print job with image data to be printed in a redundancy print mode with a resolution less than a resolution of a print head to be used to print the image data, and generate instructions to operate the print head with a redundancy addressing scheme having a number of drop states corresponding to the number of trenches fluidly coupled to the print fluid supply channel in response to receiving halftone data with the resolution divisible of the print head based on the number of trenches capable of acting redundantly. For yet another example, the processor resource 222 may carry out a set of instructions to identify printing parameters, determine a number of drops state options based on the number of trenches of the print head and the resolution of the print head, and provide a number of redundancy print modes corresponding to the number of drop state options. For yet another example, the processor resource 222 may carry out a set of instructions to generate instructions to control a processing pipeline to use color resources corresponding to the redundancy print mode using the image data resolution that is less than the print head resolution. For yet another example, the processor resource 222 may carry out a set of instructions to generate instructions to synchronize a print speed of a printer with a drop speed of the print head such that a group of single drop cells with a constant media coordinate operate in a single cell with multiple drop states the divisible of the print head. For yet another example, the processor resource 222 may carry out a set of instructions to perform the color separation operation to generate halftone data at the divisible of the print head resolution based on a number of redundancies corresponding to the number of drop states available where the halftone data causes distribution of a number of nozzle actuations less than the number of trenches to the drop cells of the group according to the redundancy addressing scheme.

Figure 4:
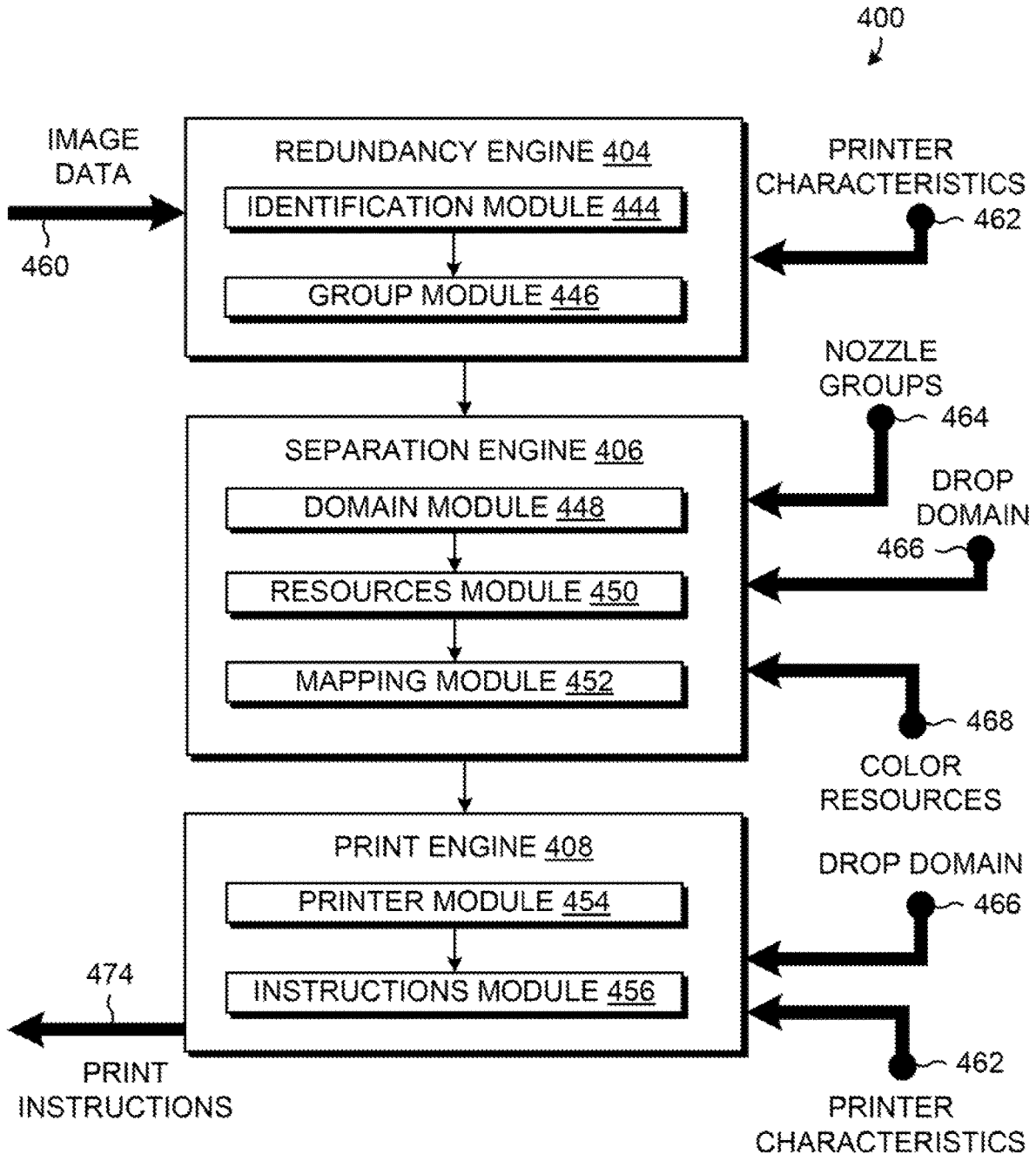
FIG. 4 depicts example components used to implement example print systems.

Although these particular modules and various other modules are illustrated and discussed in relation to FIG. 2 and other example implementations, other combinations or sub-combinations of modules may be included within other implementations. Said differently, although the modules illustrated in FIG. 2 and discussed in other example implementations perform specific functionalities in the examples discussed herein, these and other functionalities may be accomplished, implemented, or realized at different modules or at combinations of modules. For example, two or more modules illustrated and/or discussed as separate may be combined into a module that performs the functionalities discussed in relation to the two modules. As another example, functionalities performed at one module as discussed in relation to these examples may be performed at a different module or different modules. FIG. 4 depicts yet another example of how functionality may be organized into modules.

A processor resource is any appropriate circuitry capable of processing (e.g., computing) instructions, such as one or multiple processing elements capable of retrieving instructions from a memory resource and executing those instructions. For example, the processor resource 222 may be a central processing unit (CPU) that enables operation of a print apparatus in a redundancy print mode by fetching, decoding, and executing modules 204, 206, and 208. Example processor resources include at least one CPU, a semiconductor-based microprocessor, a programmable logic device (PLD), and the like. Example PLDs include an application specific integrated circuit (ASIC), a field-programmable gate array (FPGA), a programmable array logic (PAL), a complex programmable logic device (CPLD), and an erasable programmable logic device (EPLD). A processor resource may include multiple processing elements that are integrated in a single device or distributed across devices. A processor resource may process the instructions serially, concurrently, or in partial concurrence.

A memory resource represents a medium to store data utilized and/or produced by the system 200. The medium is any non-transitory medium or combination of non-transitory media able to electronically store data, such as modules of the system 200 and/or data used by the system 200. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be said to store program instructions that when executed by a processor resource cause the processor resource to implement functionality of the system 200 of FIG. 2. A memory resource may be integrated in the same device as a processor resource or it may be separate but accessible to that device and the processor resource. A memory resource may be distributed across devices.

In the discussion herein, the engines 104, 106, and 108 of FIG. 1 and the modules 204, 206, and 208 of FIG. 2 have been described as circuitry or a combination of circuitry and executable instructions. Such components may be implemented in a number of fashions. Looking at FIG. 2, the executable instructions may be processor-executable instructions, such as program instructions, stored on the memory resource 220, which is a tangible, non-transitory computer-readable storage medium, and the circuitry may be electronic circuitry, such as processor resource 222, for executing those instructions. The instructions residing on a memory resource may comprise any set of instructions to be executed directly (such as machine code) or indirectly (such as a script) by a processor resource.

In some examples, the system 200 may include the executable instructions may be part of an installation package that when installed may be executed by a processor resource to perform operations of the system 200, such as methods described with regards to FIGS. 3-7. In that example, a memory resource may be a portable medium such as a compact disc, a digital video disc, a flash drive, or memory maintained by a computer device, such as a web server, from which the installation package may be downloaded and installed. In another example, the executable instructions may be part of an application or applications already installed. A memory resource may be a non-volatile memory resource such as read only memory (ROM), a volatile memory resource such as random-access memory (RAM), a storage device, or a combination thereof. Example forms of a memory resource include static RAM (SRAM), dynamic RAM (DRAM), electrically erasable programmable ROM (EEPROM), flash memory, or the like. A memory resource may include integrated memory such as a hard drive (HD), a solid-state drive (SSD), or an optical drive.

Figure 3:
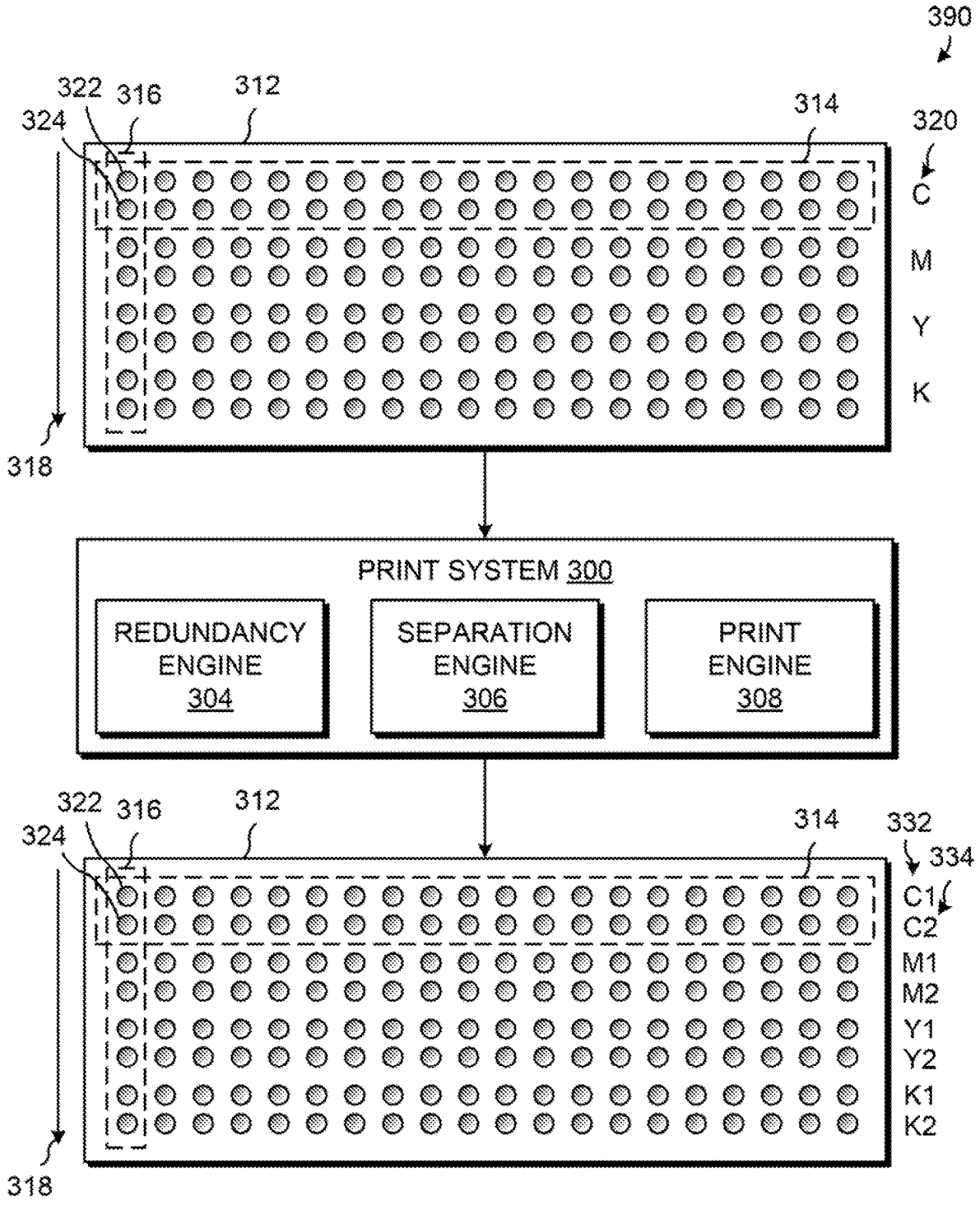
FIG. 3 depicts an example environment in which various print systems may be implemented.

FIG. 3 depicts example environments 390 in which various example print systems 300 may be implemented. The example environment 390 is shown to include an example system 300 for operating a print head in a redundancy print mode. The system 300 (described herein with respect to FIGS. 1 and 2) may represent generally any circuitry or combination of circuitry and executable instructions to readdress the print head nozzles to print in a redundancy print mode. The system 300 may include a redundancy engine 304, a separation engine 306, and a print engine 308 that are the same as the redundancy engine 104, the separation engine 106, and the print engine 108 of FIG. 1, respectively, and the associated descriptions are not repeated for brevity.

FIG. 3 depicts a print head 312 having a plurality of nozzles including nozzles 322 and 324. The print head 312 of FIG. 3 includes eight trenches (e.g., rows of nozzles with respect to the media direction 318). The print head 312 is able to print from four print fluid delivery paths including a Cyan path, a Magenta path, a Yellow path, and a Black path. Each path is associated with two trenches in the example of FIG. 3. For example, the group 314 of nozzles of FIG. 3 corresponds to trenches allocated to the Cyan path and the group 316 of nozzles includes all nozzles for the same position over the print medium with respect to the media advance direction 318 (e.g., each of the nozzles of column 316 may print over the same position of the media depending on the media advance operations). Based on the groups 314 and 316, nozzles 322 and 324 correspond to nozzles that are to print the same print fluid over the same media position with respect to the media width. The print head 312 may be readdressed by the print system 300 to operate the trenches C1 and C2 according to a redundancy addressing scheme. In the example, of FIG. 3, nozzles 322 and 324 are grouped together to act as a single nozzle in a redundancy print mode. In other words, a number of the multiple drop states corresponds to the number of drop cells in a group and a divisible of the print head resolution, where a drop cell represents a nozzle of the print head and the drop states refer to which nozzle(s) to actuate. In a redundancy print mode with use of the example of FIG. 3, the nozzle 322 or the nozzle 324 may actuate (based on a random method or a predetermined patterned) to place a drop of Cyan colorant print fluid on the media and, thereby, act as a single nozzle (e.g., operate as a single cell). To replicate similar benefits to a "second pass," both the nozzle 322 and the nozzle 324 may be actuated to place a drop at the same location on the media by synchronizing the ejection of drops (e.g., generating an actuation delay between nozzle 322 and 324 such that a drop from nozzle 322 substantially overprints a drop from nozzle 324 on the media). The result of operating the print system 300 may be that the print head 312 operates at 1200 dots per inch with redundancy rather than 2400 dots per inch without redundancy, for example.

FIG. 4 depicts example components used to implement example print systems 400. Referring to FIG. 4, the example components of FIG. 4 generally include a redundancy engine 404, a separation engine 406, and a print engine 408. The example components of FIG. 4 may be implemented on a compute device, such as print apparatus or a print server.

The image data 460 may be received into a pipeline process of the print system 400 to be processed for production in a redundancy print mode. The redundancy engine 404 includes program instructions, such as an identification module 444 and a group module 446, to assist identification of a group of nozzles based on a redundancy characteristic of the plurality of print head nozzles of a print head of the print apparatus operating the print system 400.

The identification module 444 represents program instructions that when executed cause a processor resource to identify a redundancy characteristic of a plurality of print head nozzles of a print head. The identification module 444 may also be executed to retrieve other printing parameters as discussed herein (e.g., printer characteristics 462). The redundancy characteristic may be part of the printer characteristics 462 retrievable about the print apparatus and/or print job. For example, the redundancy characteristic may be stored within the print job data, may be stored as a predetermined characteristic of print heads compatible with the class of print apparatus usable with the print system 400, may be stored on a memory resource coupled to a print head and retrievable when attached to the print system 400, may be determined based on a calibration test and sensor readings, may be retrieved from a remote memory resources, such as a data server, and/or the like.

The group module 446 represents program instructions that when executed cause a processor resource to identify a group of nozzles able to correspond to a position. The group module 446 may be executed by a processor resource to cause the processor resource to identify a plurality of groups of nozzles based on the redundancy characteristic identified by executing the identification module 444 and the redundancy engine 404 may select the group of nozzles associated with print job characteristics of the image data 460 (e.g., corresponding to an amount of redundancy associated with the type of job or as selected by a user).

The separation engine 406 includes program instructions (such as a domain module 448, a resources module 450, and a mapping module 450) to assist selection of a color separation operation corresponding to a drop domain associated with the group of nozzles identified by the redundancy engine 404.

The domain module 448 represents program instructions that when executed cause a processor resource to identify a drop domain 466 based on the nozzle groups 464 identified by the redundancy engine 404. The drop domain 466 may be different based on the redundancy to be used and/or corresponding to the color separation operation to be used.

The resources module 450 represents program instructions that when executed cause a processor resource to identify color resources 468 corresponding to the drop domain 466 and provide the color resources 468 to be used with the execution of the color separation operation. Execution of the resources module 450 may also generate resources to be selected for use by the color separation operation based on the group 462 of nozzles identified by the redundancy engine 404 and/or the redundancy characteristic of the print job and/or the print head.

The mapping module 452 represents program instructions that when executed cause a processor resource to perform a color mapping of the color separation operation to generate halftone data using the image data 460 and the color resources 468 identifiable by execution of the resource module 450.

The print engine 408 includes program instructions, such as a printer module 454 and a group module 456, to assist causing a print apparatus to eject print fluid from a print head in a manner consistent with a redundancy print mode. The printer module 454 represents program instructions that when executed cause a processor resource to identify, via the printer characteristics 462, the specific printer model to perform the printing of the image data 460. The instructions module 456 represents program instructions that when executed cause a processor resource to generate instructions 474 for the specific printer model identified by execution of the printer module 454 to cause a print head of the specific printer model to operate in a redundancy print mode using the drop domain 466 determined by the separation engine 466. The print instructions 474 are provided to the print apparatus to print the image data 460 in a redundancy print mode.

Figure 5:
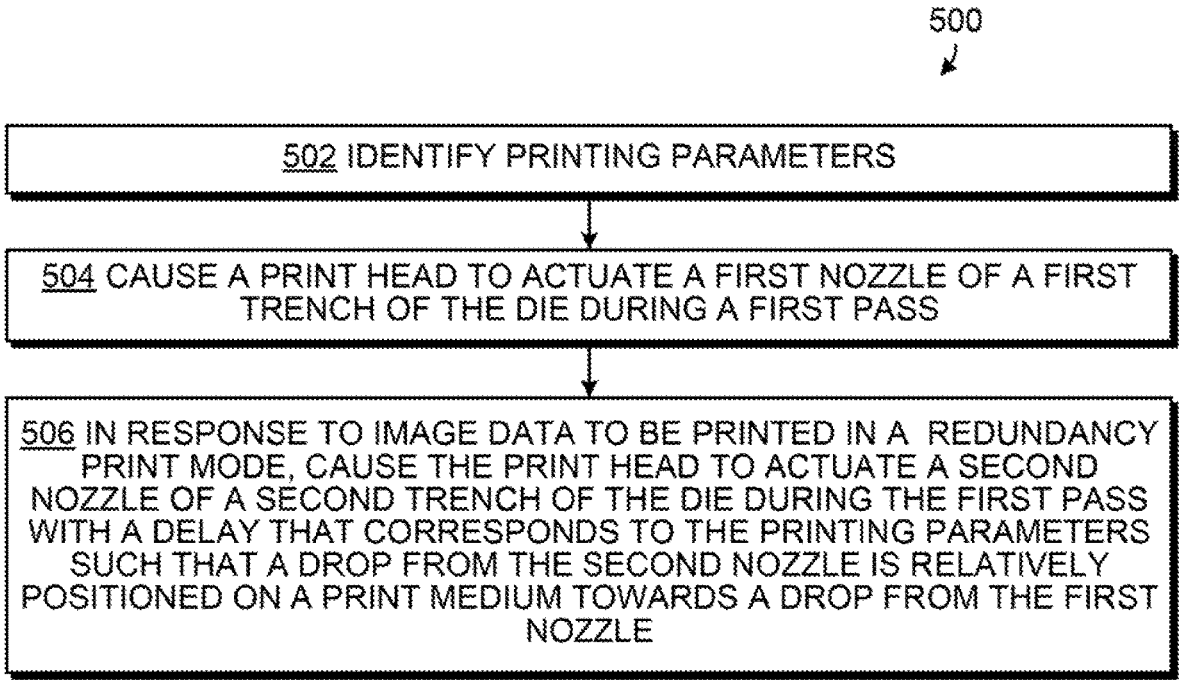
FIGS. 5 and 6 are flow diagrams depicting example methods of operating a print head.
Figure 6:
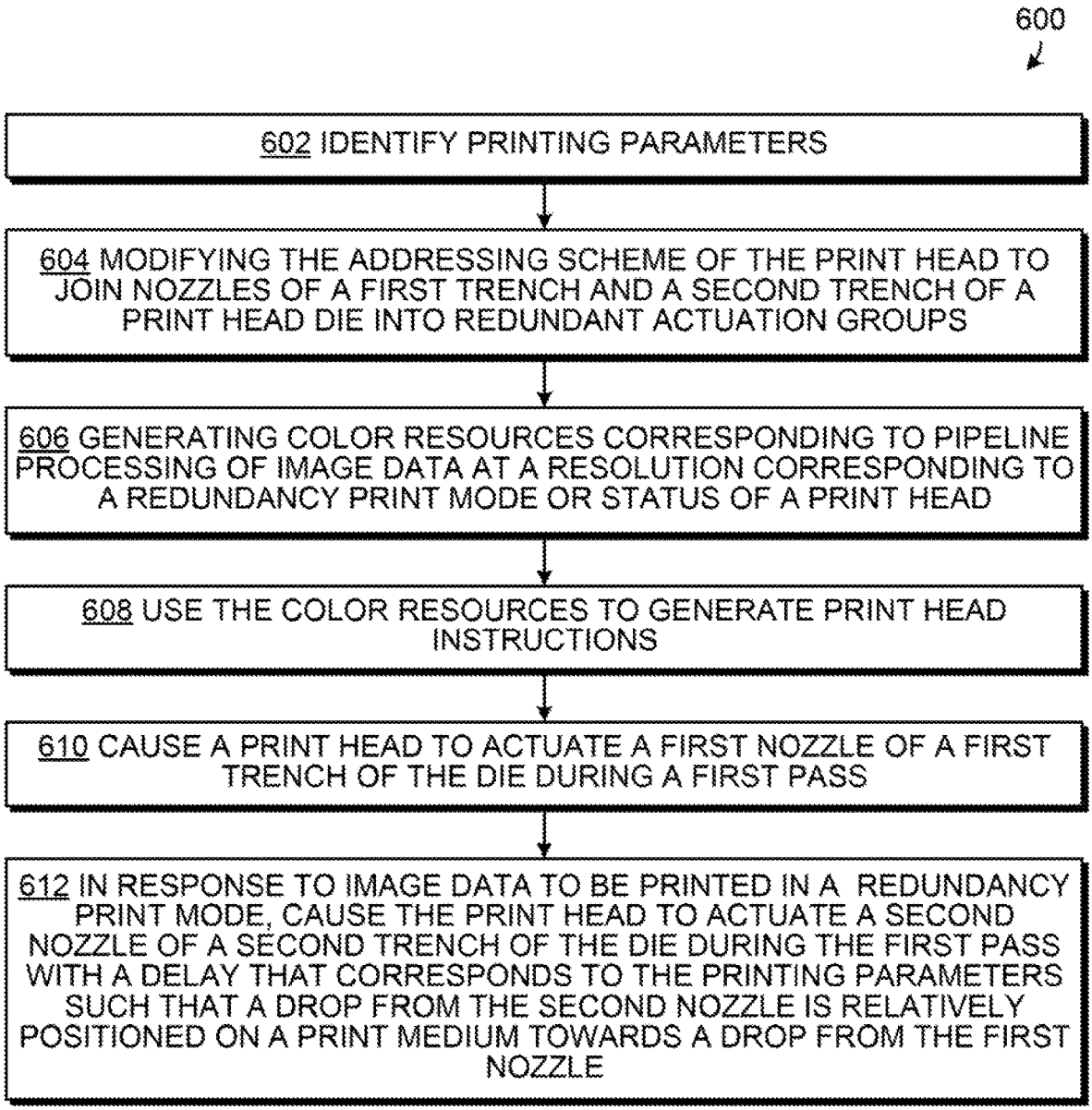

FIGS. 5 and 6 are flow diagrams depicting example methods 500 and 600 operating a print head. Referring to FIG. 5, example methods operating a print head may generally comprise identifying printing parameters and causing a first nozzle and a second nozzle to eject fluid synchronically to cause a print head to operate in a redundancy print mode. The methods 500 and 600 are performable by a print system, such as the print system 100 of FIG. 1 by operating the redundancy engine 104, the separation engine 106, and the print engine 108.

At block 502, printing parameters are identified. The printing parameters identified may be based on the print job and/or the status of the printer. Example printing parameters include print mode, job type, media speed (e.g., paper advance speed), carriage speed, drop velocity (e.g., drop speed), actuation frequency, and the like. For example, a pulse width modulation value of a motor controlling media advance mechanism of the media path may be identified and state of a drop detector may be retrieved to determine the media speed and the drop speed. For another example, the printing parameters may be specified as part of the job profile and retrieved from the data structure storing the job profile properties.

At block 504, a print head is caused to actuate a first nozzle of a first trench of the print head die during a first pass of the print head over a location of media. The first trench and a second trench correspond to the same print fluid (or corresponding print fluids, such as a dark and a light version of the same colorant).

At block 506, the print head is caused to actuate a second nozzle of a second trench of the print head die during the first pass of the print head over the location of media (e.g., the same pass and same media location as in block 504) in response to image data to be printed in a redundancy print mode. For example, the print head may, in response to a print job in a redundancy print mode, cause actuation of a second nozzle of a second trench of the print head die in the same column position as the first nozzle of the first trench with a delay that corresponds to the media speed and the drop speed such that a drop from the second nozzle is relatively positioned on a print medium towards a drop from the first nozzle. The centers of the drops in that example may effectively be placed near each other based on the delay, where the position without a delay may leave the drops to land on the media with their centers about the same distance apart as the distance between the first trench and the second trench. The drops of the first and second nozzle may substantially overlap. If the drop of the second nozzle of the second trench ejects a drop of a drop weight different than the first nozzle of the first trench, the drops may overlap even when the drops are not ejected with a trajectory positioned towards the same location; however, in a redundancy print mode the trajectories may be set closer such that the drops ejected towards the same location depending on the desired effect as defined by the halftone data.

FIG. 6 includes blocks similar to blocks of FIG. 5 and provides additional blocks and details. In particular, FIG. 6 depicts additional blocks and details generally regarding modifying the addressing scheme of the print head and using color resources adapted for use with a redundancy print mode. Blocks 602, 610, and 612 are the same as blocks 502, 504, and 506 of FIG. 5 and, for brevity, their respective descriptions are not repeated.

At block 604, the addressing scheme of the print head is modified to join nozzles of the first trench and the second trench into redundant actuation groups. The redundant actuation groups allow for the group to eject a drop from a nozzle of the group where each nozzle of the group act to eject towards the substantially same media location. For example, the first nozzle of the first trench and the second nozzle of the second trench described with regards to method 500 may be actuated towards the same location on the media where the drops are substantially overprinted with their centers at the same location (or trivially offset). The redundant actuation groups may actuate a first nozzle and/or a second nozzle at a particular media location during a pass, such that the nozzles of the group that are selected to actuate are selected based on the number of drops to actuate by that group and selecting the nozzles randomly (e.g., any nozzle of the group has an equal opportunity to actuate at each activation of the group) or based on a pattern (e.g., evenly rotate which nozzle is actuated for each activation of the group such as by tracking a history of the nozzle group actuation and not selecting the previously actuated nozzle).

At block 606, color resources are generated corresponding to the pipeline processing of the image data for reproduction at a resolution corresponding to the redundancy print mode (or a status of the print head). For example, the print head status, such as based on drop detector data, may indicate the color separation operation to be performed utilizes color resources that have not yet been generated and/or adjusting stored color resource to correspond to the print job to print the image data in the redundancy print mode. In other examples, the resources used with the redundancy print mode may be predetermined and stored on a memory resource of the print apparatus.

At block 608, the color resources generated at block 606 are used to generate print head instructions that cause the second nozzle of the second trench of the print head die to actuate according to a redundancy addressing scheme. For example, the color resources may be used to generate halftone data usable by a print apparatus to cause a first nozzle and a second nozzle to act as a single nozzle cell such that the print head is addressed to operate in a redundancy print scheme with a resolution lower than the maximum resolution of the print head. By utilizing a color separation operation with color resources corresponding to operating the print head in a redundancy print mode, the halftone data may correspond to print head addressing of nozzles in groups to provide redundant-like print quality of the image data when a print apparatus does not include additional print bars or is otherwise incapable of performing multiple passes of print fluid over a media location.

Figure 7:
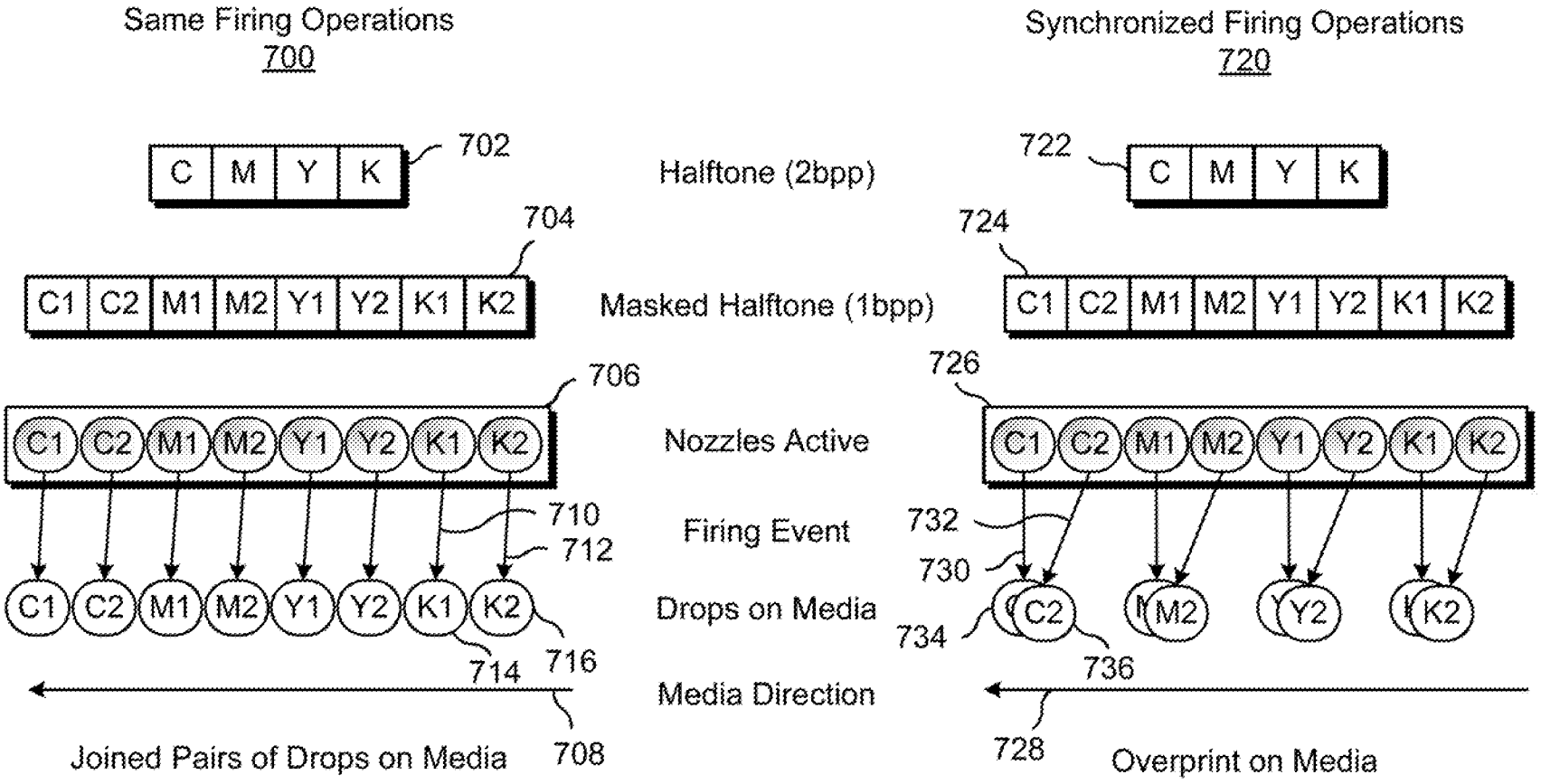
FIG. 7 depicts examples of methods of operating a print head.

FIG. 7 depicts examples of methods 700 and 720 of operating a print head according to a redundancy addressing scheme. The example methods 700 and 720 may be used as part of a color pipeline to process image data using a look-up table that uses two drop states at half the resolution of the print head on a print system with a single print head or single print bar, such as in the example of FIG. 3. Halftone data (702 and 722) may include per pixel color information corresponding to colorants of a print system available to the print head. A print-mask is employed to generate a masked halftone (704 and 724) such that it distributes the two drop states to adjacent nozzles of the physical print head. For example, the halftone data may describe colorant data in a two bits per pixel format and the masked halftone describe the colorant data in a one bit per pixel format. The masked halftone data is representative of the nozzles to actuate such that if a one drop state is present in the pre-masking halftone then this is placed in one of the two possible positions (e.g., a single nozzle of the group is chosen randomly or based on a pattern), while if a two drop state is present in the pre-masking halftone then both positions are occupied (e.g., both nozzles of the group actuate). The masked halftone prints (e.g., causes nozzles 706, 726 to activate) as if it only has one drop state, but the result is the same as that of a two drop state, at half resolution, using a look up table and a masking that distributes the two drop states in one cell in a two cell fashion where the two drop state results in two adjacent nozzles of a color being used. The result of that example method is not guaranteed by halftone operations alone, but is possible by readdressing the print head to operate with a redundancy addressing scheme using groups of nozzles to operate as single cells.

Using the examples discussed herein, the print head may actuate the trenches to be synchronized with the print speed (in the media direction 708, 728) and drop speed such that two single drop cells with a constant X coordinate, in effect, result in a single two drop state at half the print resolution. The print systems discussed herein may be deployed on a continuum of the level of control of actuation events (e.g., 710, 712, 730, 732). Under general printing operations, increased control is delivered by the introduction of groups of nozzles (e.g., joined pairs of drops 714 and 716), whether the drops end up overprinting or not. Method 700 is an example thereof.

At the other end of the level of control is method 720. Individual trenches can be actuated with a delay that relates to media speed and drop speed such that the row of C2*s* is actuated first, with C1*s* actuated with a delay that results in C1*s* and C2*s* overprinting (e.g., overprinted pairs 734 and 736). Overprinting, as discussed herein, includes the theory that the drops overlap exactly, and includes that in practice some misalignment may result (similar to the situations in multipass printing).

Regarding method 720, the impact may be more substantial in terms of increased gamut and error hiding possibilities due to possible multiple drop states because it would allow a strictly overprinting state on a single print bar system, that, without use of the methods described herein, would allow for partial overprinting as a consequence of drop size and print resolution with halftone data representing single drop states. In practice of the print systems and methods described, the result of such control is somewhere between the "joining" of pairs of single drop states of method 700 and that of a "perfect overprinting" envisioned by method 720. By utilizing a print head in a redundancy print mode as described herein, image quality may be bolstered by having redundancy of nozzles to increase robustness without increasing the number of passes, for example. The redundancy print mode described herein may, as examples, also improve image quality artifacts (e.g., grain) due to the ability to have more colors (e.g., more Neugebauer primaries) and possible better color alignment due to smaller distances between color trenches and, therefore, have more control on where drops are positioned.

Although the flow diagrams of FIGS. 4-7 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus. Furthermore, the use of the words "first," "second," or related terms in the claims are not used to limit the claim elements to an order or location, but are merely used to distinguish separate claim elements.

The present description has been shown and described with reference to the foregoing examples. It is understood, however, that other forms, details, and examples may be made without departing from the spirit and scope of the following claims.

What is claimed is:

1. A print system comprising:

a print head station to receive a print head with a plurality of nozzles and communicatively couple the print head to the print system;

a redundancy engine to:

identify a group of nozzles based on a redundancy characteristic of the plurality of print head nozzles of the print head to be received at the print head station;

a separation engine to:

select a color separation operation corresponding to a drop domain associated with the group of nozzles identified by the redundancy engine to operate the print head with redundancy; and a print engine to:

generate instructions using the selected color separation operation to cause the print head to eject print fluid from a combination of nozzles corresponding to the group of nozzles based on the drop domain to operate the print head with a redundancy print mode.

2. The print system of claim 1, wherein:

the redundancy characteristic corresponds to a number of trenches of a die output from a common delivery path designated to a particular print fluid.

3. The print system of claim 2, wherein the redundancy engine is to:

identify a plurality of nozzle redundancy options based on a number of nozzles of identifiable nozzle groupings based on the number of trenches;

and select the group of nozzles from the number of identifiable nozzle groupings based on the print job data.

4. The print system of claim 1, wherein:

the print head includes a plurality of trenches corresponding to a single colorant print fluid, a column of nozzles being the group of nozzles corresponding to a nozzle position of the nozzles in each of the trenches; and the redundancy engine is to define the drop domain by associating a drop state for each nozzle in each column.

5. The print system of claim 4, wherein:

the nozzles of the column to actuate are selected based on the drop state for the group of nozzles resulting from the color separation operation; and, when the drop state is less than actuation all nozzles in the column, the separation engine is to generate halftone data that corresponds to drop states that causes a subset of the nozzles of each column to actuate randomly or based on a pattern.

6. The print system of claim 1, wherein the separation engine is to:

cause color resources to be generated to operate the print head at a reduced resolution; and use the generated color resources to generate a print mask with a halftone data to operate the print head at the reduced resolution.

7. The print system of claim 1, wherein the separation engine is to:

receive a print job with image data to be printed in a redundancy print mode with a resolution less than a resolution of the print head at the print head station, the print head having a number of trenches fluidly coupled to a print fluid supply channel that enable printing with redundancy; and perform a color separation operation to generate halftone data with a resolution at a divisible of the print head resolution based on the number of trenches fluidly coupled to the print fluid supply channel.

8. The print system of claim 7, wherein the print engine is to, in response to receiving the halftone data from the separation engine, generate instructions to operate the print head with a redundancy addressing scheme having a number of drop states corresponding to the number of trenches fluidly coupled to the print fluid supply channel.

9. The print system of claim 1, wherein the redundancy engine is further to:

identify printing parameters including a media speed and a drop speed;

determine a number of drops state options based on a number of trenches of the print head and a resolution of the print head; and provide a number of redundancy print modes corresponding to the number of drop state options.

10. The print system of claim 1, wherein the print head station is fixed and, with the print head installed, constitutes a single, fixed print bar, wherein the print system has only that single, fixed print bar to be operated in the redundancy print mode.

11. The print system of claim 1, wherein:

the redundancy engine is further to identify printing parameters including a media speed and a drop speed and determine a redundancy print mode;

the print engine, based on the determined redundancy print mode, is further to cause the print head to actuate a first nozzle of a first trench of the print head during a first pass, the first trench corresponding to a first print fluid and cause the print head to actuate a second nozzle of a second trench of the print head die during the first pass with a delay that corresponds to the media speed and the drop speed such that a drop from the second nozzle is relatively positioned on a print medium towards a drop from the first nozzle.

12. A non-transitory computer-readable storage medium comprising a set of instructions executable by a processor resource to:

in response to receiving a print job with image data to be printed in a redundancy print mode with a resolution less than a resolution of a print head to be used to print the image data that is capable of operating with redundancy by having a number of trenches fluidly coupled to a print fluid supply channel, generate instructions to control the processing pipeline to perform a color separation operation to generate halftone data with a resolution at a divisible of the print head resolution based on the number of trenches fluidly coupled to the print fluid supply channel; and in response to receiving halftone data with the resolution divisible of the print head based on the number of trenches capable of acting redundantly, generate instructions to operate the print head with a redundancy addressing scheme having a number of drop states corresponding to the number of trenches fluidly coupled to the print fluid supply channel.

13. The medium of claim 12, wherein the set of instructions is executable by the processor resource to:

identify printing parameters including a media speed and a drop speed;

determine a number of drops state options based on the number of trenches of the print head and the resolution of the print head; and provide a number of redundancy print modes corresponding to the number of drop state options.

14. The medium of claim 12, wherein the set of instructions is executable by the processor resource to:

generate instructions to control a processing pipeline to use color resources corresponding to the redundancy print mode using the image data resolution that is less than the print head resolution.

15. The medium of claim 14, wherein the set of instructions is executable by the processor resource to:

generate instructions to synchronize a print speed of a printer with a drop speed of the print head such that a group of single drop cells with a constant media coordinate operate in a single cell with multiple drop states the divisible of the print head.

16. The medium of claim 15, wherein:

a number of the multiple drop states corresponds to the number of drop cells in a group and a divisible of the print head resolution, wherein a drop cell represents a nozzle of the print head.

17. The medium of claim 16, wherein the set of instructions is executable by the processor resource to, comprising:

perform the color separation operation to generate halftone data at the divisible of the print head resolution based on a number of redundancies corresponding to the number of drop states available, the halftone data to distribute a number of nozzle actuation less than the number of trenches to the drop cells of the group according to the redundancy addressing scheme.

18. A method of operating a print head comprising:

identifying printing parameters including a media speed and a drop speed;

causing the print head to actuate a first nozzle of first trench of a print head die during a first pass, the first trench corresponding to a first print fluid; and in response to image data to be printed in a redundancy print mode, causing the print head to actuate a second nozzle of a second trench of the print head die during the first pass with a delay that corresponds to the media speed and the drop speed such that a drop from the second nozzle is relatively positioned on a print medium towards a drop from the first nozzle.

19. The method of claim 18, comprising:

generating color resources corresponding to pipeline processing of the image data at a resolution corresponding to the redundancy print mode or a status of the print head; and using the color resources to generate print head instructions that cause the second nozzle of the second trench of the print head die to actuate according to a redundancy addressing scheme.

20. The method of claim 19, comprising:

modifying the addressing scheme of the print head to join nozzles of the first trench and the second trench into redundant actuation groups that actuate, at a particular location of the media, the first nozzle of the first trench or the second nozzle of the second trench during the first pass, the first nozzle or the second nozzle selected randomly or based on a pattern.

* * * * *